United States Patent [19]

Iijima

[11] 4,310,939

[45] Jan. 19, 1982

[54] METHOD OF PRODUCING SEMICIRCULAR WASHERS HAVING A PROJECTION TO PREVENT ROTATION

[75] Inventor: Yoshio Iijima, Nagoya, Japan

[73] Assignee: Daido Metal Company Ltd., Japan

[21] Appl. No.: 82,184

[22] Filed: Oct. 5, 1979

[30] Foreign Application Priority Data

Oct. 6, 1978 [JP] Japan ..... 53-123934

[51] Int. Cl.[3] ..... B21D 53/20

[52] U.S. Cl. ..... 10/86 B; 10/73; 72/168

[58] Field of Search ..... 10/85, 86 R, 86 B, 73; 72/168, 171; 151/36

[56] References Cited

U.S. PATENT DOCUMENTS

| | | | |
|---|---|---|---|
| 2,043,665 | 6/1936 | Iversen et al. | 72/171 X |
| 3,902,209 | 9/1975 | Gohs | 10/86 B X |
| 4,151,733 | 5/1979 | Iijima | 72/168 |

FOREIGN PATENT DOCUMENTS 54-3065 2/1979 Japan .

*Primary Examiner*—Mark Rosenbaum
*Attorney, Agent, or Firm*—Karl W. Flocks

[57] ABSTRACT

In producing a semicircular washer having a projection to prevent rotation formed thereon, a blank material in the form of a flat bar is forced to pass a roll caliber between upper and lower forming rolls arranged in a pair and bent on and along one of the forming rolls while being pressed in the breadthwise direction to become a semicircular washer. The semicircular washer then has its outer marginal portion punched out by means of a punch and a die to form thereon a projection for preventing rotation. The method ensures an increase in the yield of semicircular washers having a projection for preventing rotation and enables the projection to be formed in any position on the washer as desired.

3 Claims, 6 Drawing Figures

METHOD OF PRODUCING SEMICIRCULAR WASHERS HAVING A PROJECTION TO PREVENT ROTATION

BACKGROUND OF THE INVENTION

This invention relates to a method for producing semicircular washers having a projection for preventing rotation (hereinafter referred to as semicircular washers having a projection), and more particularly it is concerned with a method for producing semicircular washers having a projection which enables accurately shaped articles having accurate dimensions to be produced while permitting a yield to be increased by minimizing waste material.

In the art of producing semicircular washers having such a projection, there have hitherto been available some methods known in this technical field. They are summarized as follows:

(1) A method wherein semicircular washers having a projection are produced by using a press machine for successively producing semicircular washers having a projection as end products by punching a web material of large width; and (2) A method wherein the forward end portion of a web material is bent by a bender or a coiling machine to shape same into a semicircular washer which is severed from the rest of the material and placed in a lower die provided with a recess of a press machine or the like. An upper die formed with a projection is moved downwardly upon the lower die to apply pressing force to the semicircular washer to form a projection for preventing rotation at the outer periphery of the semicircular washer.

The method described in paragraph (1) hereinabove has the disadvantage of being uneconomical because waste material is large in amount.

The method described in paragraph (2) hereinabove has the disadvantage that the web material is not completely enclosed while bending operation is carried out and consequently cracks are liable to be formed on the outer periphery of the bent portion of the material due to elongation thereof. Moreover, in order to produce end products of an accurate semicircular shape having dimensional accuracy, it is necessary to use the upper and lower dies of said press machine.

The use of the upper and lower dies with the press machine has the disadvantage that the position in which the projection for preventing rotation is formed is limited to substantially the middle portion of each semicircular washer. Thus, when the method described in paragraph (2) is used for producing semicircular washers having a projection, the thickness of each washer inevitably tends to become greater in the vicinity of the projection to prevent rotation than in other portions thereof, and as a result, the washer as a whole has an uneven thickness, because the upper and lower dies and the web material must have some extent of tolerance in dimensions. Therefore, this method has an additional disadvantage that it must include a finish machining step.

SUMMARY OF THE INVENTION

An object of the present invention is to provide a method of producing semicircular washers which obviates the aforementioned disadvantages of the prior art and enables semicircular washers having such projection to be economically produced with an increased yield.

Another object is to provide a method of producing semicircular washers which enables a projection to prevent rotation having accurate dimensions to be formed in a desired position on the semicircular washer.

A further object is to provide a method of producing semicircular washers which dispenses with a thickness finishing step because no large thickned portion is formed in the vicinity of the projection for preventing undesired rotation of the semicircular washer.

To accomplish these objects, according to the present invention, there is provided a method of producing semicircular washers having a projection comprising the step of pressing and bending in the breadthwise direction a flat blank material having a width and a thickness by using the method of producing thrust washers of ring or arcuate shape (Japanese Patent Publication No. 3065/79 and U.S. Pat. No. 4,151,733) invented by the present inventor, to become a semicircular washer. And the step of punching the outer marginal portion of the semicircular washer produced in the preceding step by means of shearing tools, to form a projection to prevent rotation on the outer periphery of the semicircular washer, thereby producing a semicircular washer having a projection.

BRIEF DESCRIPTION OF THE DRAWINGS

The drawings illustrate one embodiment of the present invention.

DESCRIPTION OF THE PREFERRED EMBODIMENT

Figure 1:
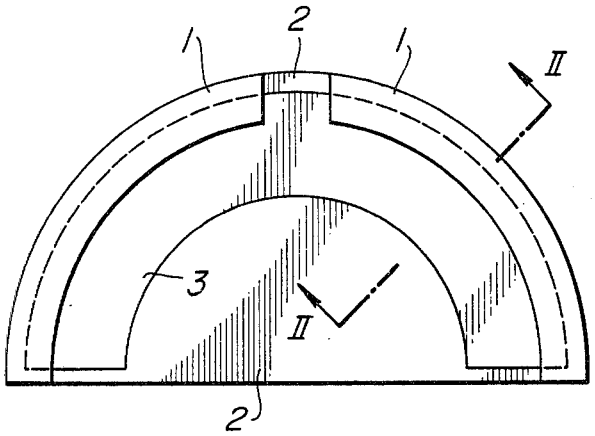
FIG. 1 is a plan view of a semicircular washer and shearing tools, showing their relative positions prior to the production of a semicircular washer having a projection by punching out an ordinary semicircular washer by means of the shearing tools.
Figure 2:
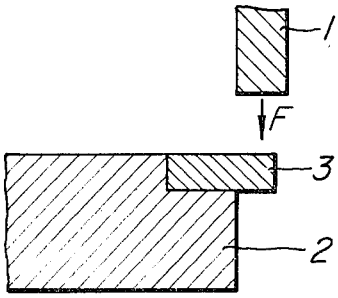
FIG. 2 is a sectional view taken along the line II—II in FIG. 1.
Figure 3:
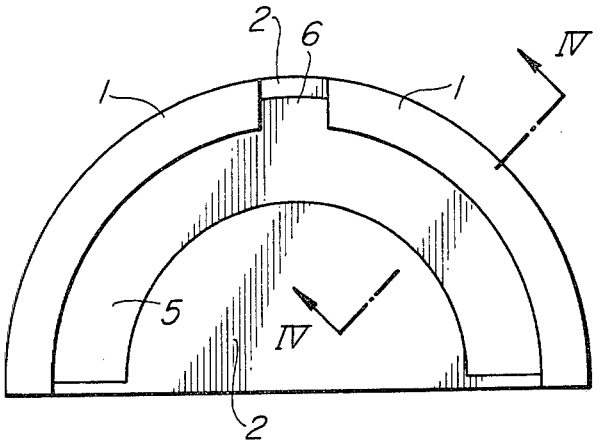
FIG. 3 is a plan view of the semicircular washer and the shearing tools of FIG. 1, showing the semicircular washer having been punched out at its outer marginal portion by the shearing tools to form thereon a projection for preventing undesirable rotation of the washer in use.
Figure 4:
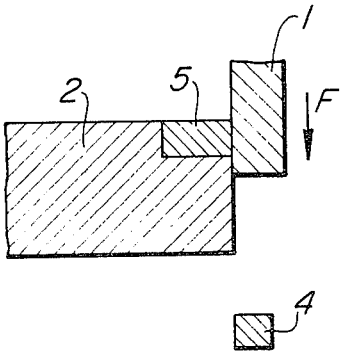
FIG. 4 is a sectional view taken along the line IV—IV in FIG. 3.
Figure 5:
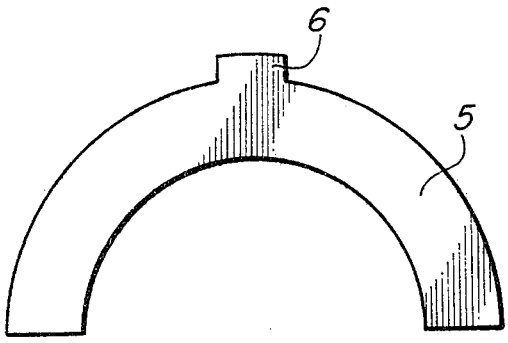
FIG. 5 is a plan view of the semicircular washer produced by punching out the outer marginal portion of the ordinary semicircular washer.
Figure 6:
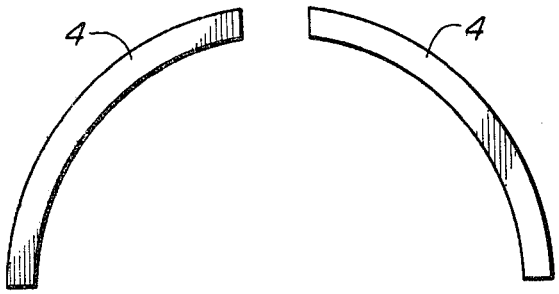
FIG. 6 is a plan view of scrap material produced after the semicircular washer having a projection has been formed by punching out the outer marginal portion of the ordinary semicircular washer.

A preferred embodiment of the present invention will now be described by referring to the accompanying drawings. As shown in FIGS. 1 to 4, shearing tools including a punch or upper die 1 and a die or lower die 2 are used to punch out the outer marginal portion of an ordinary semicircular washer 3 produced by the method described in U.S. Pat. No. 4,151,733 invented by the present inventor, by moving the punch 1 in the direction shown by an arrow F. A pressure plate and hold-down bolts for the washer 3 are not shown. When the aforesaid punching operation is performed, scrap material 4 formed each time a semicircular washer having a projection 5 is produced is much smaller in amount than the scrap material which would be produced when a conventional method, such as the method described in paragraph (1) hereinabove, were used. Thus the present invention increases the yield of aimed semicircular washers by minimizing waste material.

The subject matter of the invention of U.S. Pat. No. 4,151,733 developed by the present inventor is a method of producing thrust washers 3 of ring shape or arcuate shape wherein a blank material in the form of a flat bar obtained by cutting a web material is forcibly passed into a roll caliber defined by a pair of upper and lower forming rolls of a smaller width than the blank material, and is pressed onto one of the forming rolls to be bent in the breadthwise direction. Thus the method is intended to produce a semicircular washer by subjecting the blank material to complete plastic deformation.

In the embodiment described hereinabove, the position of the projection to prevent rotation 6 formed on the outer periphery of the semicircular washer 5 produced by punching operation is shown at the center of the semicircular washer 5. It is to be understood that the present invention is not limited to this specific example where position of the projection 6 for preventing rotation but the projection 6 may be formed in any desired position by changing the positions of the projection forming portions of the punch 1 and the die 2.

From the foregoing description, it will be appreciated that the method of producing semicircular washers having a projection according to the present invention is capable of increasing yield in production and free from the risk of cracks being formed on the outer periphery of each washer. Also, since the projection for preventing projection is formed by punching out the outer marginal portion of the semicircular washer, the invention offers the great advantage of enabling the projection for preventing rotation to be formed in any position as desired on the semicircular washer. Moreover, the invention enables a projection for preventing rotation to be formed without forming a large thickened portion in the semicircular washer having a projection, and the need to perform a thickness finishing operation after the forming of the semicircular washer is eliminated. The invention enables semicircular washers having projection with high dimensional accuracy to be produced at low cost.

What is claimed is:

1. A method for producing semicircular washers having a projection for preventing rotation, comprising the steps of:

forcing a flat bar blank to pass through a confined or closed roll caliber defined between an upper and lower forming rolls arranged in a pair to form said flat bar blank to be bent on and along one of said forming rolls while being compressed in the breadthwise direction to produce a semicircular washer, wherein said flat bar blank has been prepared to have a width larger than that of said roll caliber; and punching out the outer marginal portion of said semicircular washer to using shearing tools to form the projection for preventing rotation on said semicircular washer, thereby to provide a semicircular washer having a projection for preventing rotation thereof.

2. A method as claimed in claim 1, wherein said projection for preventing rotation is formed in any selected position on the outer periphery of said semicircular washer.

3. A method as claimed in claim 1 or 2, wherein said shearing tools include a punch and a die.

* * * * *